US008220873B2

(12) United States Patent
Kemp et al.

(10) Patent No.: US 8,220,873 B2
(45) Date of Patent: Jul. 17, 2012

(54) KEMLOK ADULT BOOSTER SEAT SYSTEM

(76) Inventors: Deborah Muller Kemp, North Canton, OH (US); Marilyn Lorraine Lokken, Reno, NV (US)

( * ) Notice: Subject to any disclaimer, the term of this patent is extended or adjusted under 35 U.S.C. 154(b) by 32 days.

(21) Appl. No.: 12/798,172

(22) Filed: Mar. 31, 2010

(65) Prior Publication Data

US 2011/0241388 A1 Oct. 6, 2011

(51) Int. Cl.
*A47C 7/02* (2006.01)
*A47C 7/62* (2006.01)
*B68B 5/00* (2006.01)

(52) U.S. Cl. ..... 297/452.23; 297/217.1; 5/653

(58) Field of Classification Search ..... 297/452.28, 297/452.26, 452.41, 452.21, 217.1; 5/685, 5/653; 190/8
See application file for complete search history.

(56) References Cited

U.S. PATENT DOCUMENTS 1,775,061 A * 9/1930 Bertha ..... 5/490
2,805,430 A * 9/1957 Philbrick ..... 114/363
3,148,389 A * 9/1964 Lustig ..... 5/645
4,157,134 A * 6/1979 Stoll ..... 190/1
4,185,673 A * 1/1980 Daniello ..... 383/14
4,255,824 A * 3/1981 Pertchik ..... 5/630
4,459,714 A * 7/1984 Lin ..... 5/655.3
4,615,856 A * 10/1986 Silverman ..... 264/222
4,843,662 A * 7/1989 Handelman ..... 5/653
4,899,405 A * 2/1990 Rothbard ..... 5/636
4,953,673 A * 9/1990 Ambasz ..... 190/103
5,536,071 A * 7/1996 Kraftick ..... 297/423.41
5,855,415 A * 1/1999 Lilley, Jr. ..... 297/452.27
5,953,777 A * 9/1999 Buck ..... 5/636
5,987,676 A * 11/1999 Littleford et al. ..... 5/636
6,625,830 B2 * 9/2003 Lampel ..... 5/653
6,749,159 B1 * 6/2004 Hess ..... 248/118
7,614,704 B2 * 11/2009 Whelan et al. ..... 297/452.25
2006/0103225 A1 * 5/2006 Kim ..... 297/452.26

* cited by examiner

*Primary Examiner* — Milton Nelson, Jr.
(74) *Attorney, Agent, or Firm* — Sand & Sebolt

(57) ABSTRACT

The Booster Seat System is a lightweight, portable, non-mechanical, affordable system in its own carrying case, which enables people with diminished strength in the back and/or legs, such as recovering surgical patients, elderly, disabled, or obese people and/or pregnant women, to comfortably and safely attain a standing position from most seating arrangements without the assistance of another person.

2 Claims, 4 Drawing Sheets

KEMLOK ADULT BOOSTER SEAT SYSTEM

CROSS-REFERENCE TO RELATED APPLICATIONS

This application claims priority from U.S. Provisional Application Ser. No. 61/276,151, filed Sep. 9, 2009, the disclosure of which is incorporated herein by reference.

BACKGROUND OF THE INVENTION

The general field of the Booster Seat System is medical/physical therapy daily use equipment. The specific field of the Booster Seat System is a product that can be easily utilized by people with diminished strength in the legs or back to safely and comfortably attain a standing position from a seated position without physical assistance.

The Booster Seat System is designed for patients, elderly, disabled, obese people, pregnant women or any person with diminished strength in their legs or back. These people have a common problem: the inability to safely attain a standing position from a seated position. The above-mentioned people often limit their activities because of fear, embarrassment and humiliation of being "trapped" in a chair from which they cannot rise because the seat sets too low. They fear making a spectacle of themselves, as other people must assist them. Pulling, pushing or leveraging these people can cause injuries to them and their helpers. Even if assistance is available to the affected person, the person will often panic, fearing injury, causing a more difficult situation. Patients recovering from surgery may have a temporary disability. At home the patient may have a single chair from which he/she can rise easily. The patient is reluctant to leave home during the recovery process for fear of getting "trapped" in a chair somewhere. The isolation factor can further impede recovery. Patients stand at a doctor's office rather than risk sitting in a waiting room chair. Disabled people hold onto their walkers and remain standing rather than try to sit in an unfamiliar chair.

The Booster Seat System provides the unassisted capability for the user to customize the additional seat height needed to safely and comfortably attain a standing position.

The Booster Seat System is lightweight, non-mechanical, portable and affordable. Other devices are mechanical, heavy, installed in a specific chair, static in height, expensive and/or do not provide the flexibility for the user to easily transport the seat to a variety of locations. The Booster Seat System is affordable because of the simplicity of its design and the use of lightweight plastic in its construction. A user on a fixed income or with a temporary disability could afford to buy the Booster Seat System rather than remain isolated at home.

BRIEF SUMMARY OF THE INVENTION

The Booster Seat System is comprised of six components: four identical stackable seating pads enclosed in a padded carrying case with a liner bag. The user places one or more seating pads in the padded carrying case; places the padded carrying case on a chair as a cushion to provide sufficient height to attain a standing position. If the user needs less than four seating pads, the unneeded seating pads are placed in the liner bag and placed next to the chair. The user rises from the chair, places the liner bag and its contents of one or more seating pads into the padded carrying case alongside those seating pads already in the padded carrying case, and then removes the carrying case from the chair. This system allows the user to discreetly customize the height of the system by increments to permit the user to sit in almost any seating arrangement and safely attain a standing position without physical assistance from another person.

DETAILED DESCRIPTION OF THE INVENTION

The Booster Seat System is intended to resolve the problem of easily and safely attaining a standing position from almost any seated position in most types of locations, using this lightweight, non-mechanical, incremental height variation, portable and affordable system by people with diminished strength in the back and/or legs. Existing products: Products currently available fail to address this problem because they are heavy, mechanical, installed in a specific chair, static in height, expensive and/or do not provide the flexibility for the user to easily transport the seating assistance product to a variety of locations. Many of the potential users of the Booster Seat System currently stack books, cushions, or even telephone books on chairs to resolve the problem: all of which are unstable and unsafe.

Figure 1:
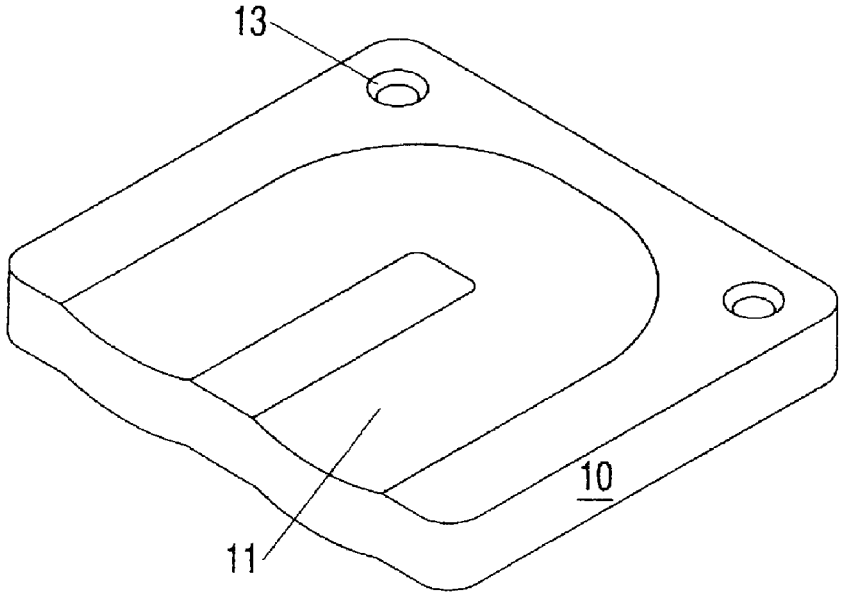
FIG. 1 is a perspective view of the top of one of four identical seat pads.
Figure 2:
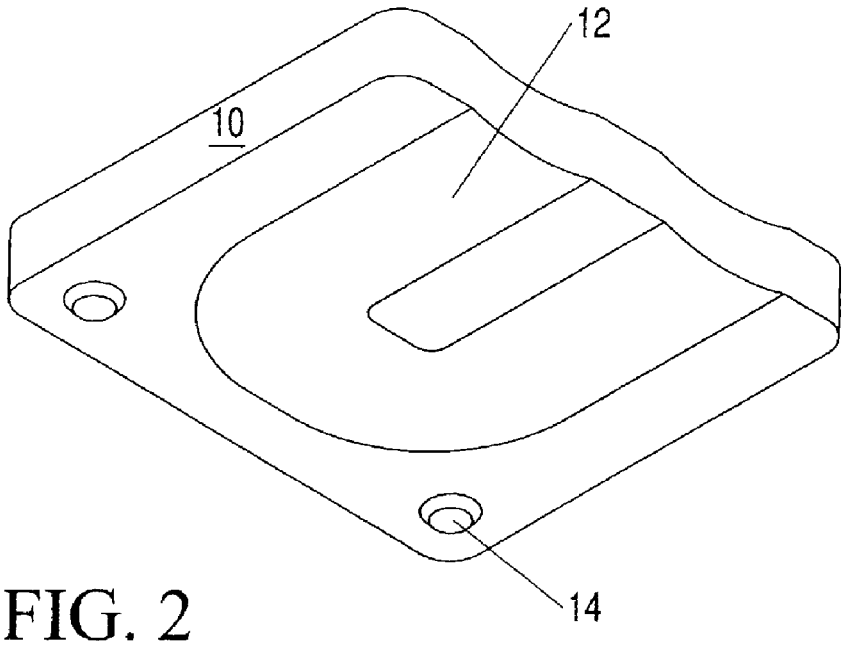
FIG. 2 is a perspective view of the bottom of one of four identical seat pads.

The attached Drawings of the Booster Seat System are explained as follows:

FIG. 1 is the view of the top of one of four identical seat pads. Each pad (10) has an indentation of an adult anatomical buttock area imprint (11) and a smaller indentation (13) near the two rear corners. In FIG. 2, which is the underside of FIG. 1, the corner indentations (13) shown in FIG. 1 are protruded (14) in FIG. 2. When the pads are stacked one on top of the other, the corner indentations (13) and (14) prevent the seat pads from slipping inside the padded carrying case (15). Also in FIG. 2 the buttock imprint (11) on FIG. 1 is reversed (12). When the seat pads are stacked together, this configuration also helps to eliminate slippage of the pads (10) inside the padded carrying case (15). Both sides of the seat pads' flat surfaces have a non-skid textured surface which also prevents slippage when stacked inside the padded carrying case (15).

Figure 3:
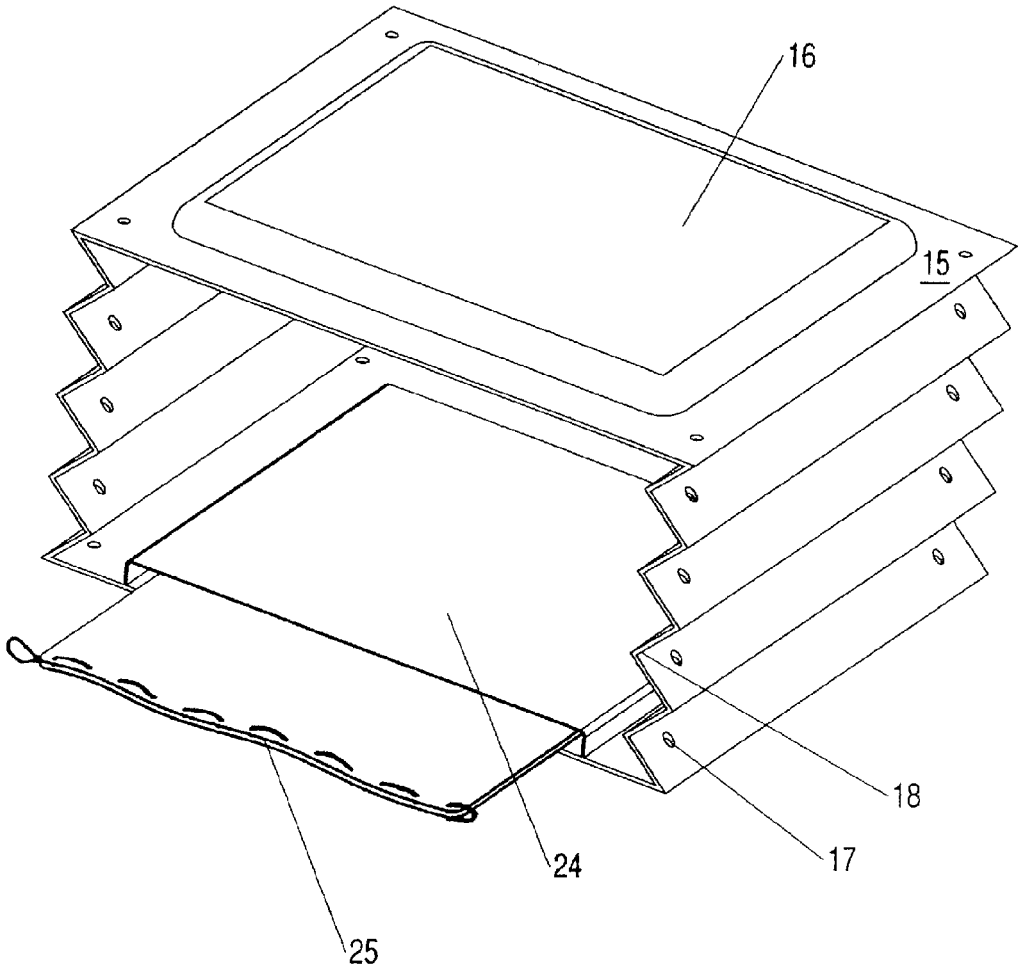
FIG. 3 is a perspective view of the padded carrying case component, showing liner bag, liner bag pocket, pleats and drawstring openings.
Figure 4:
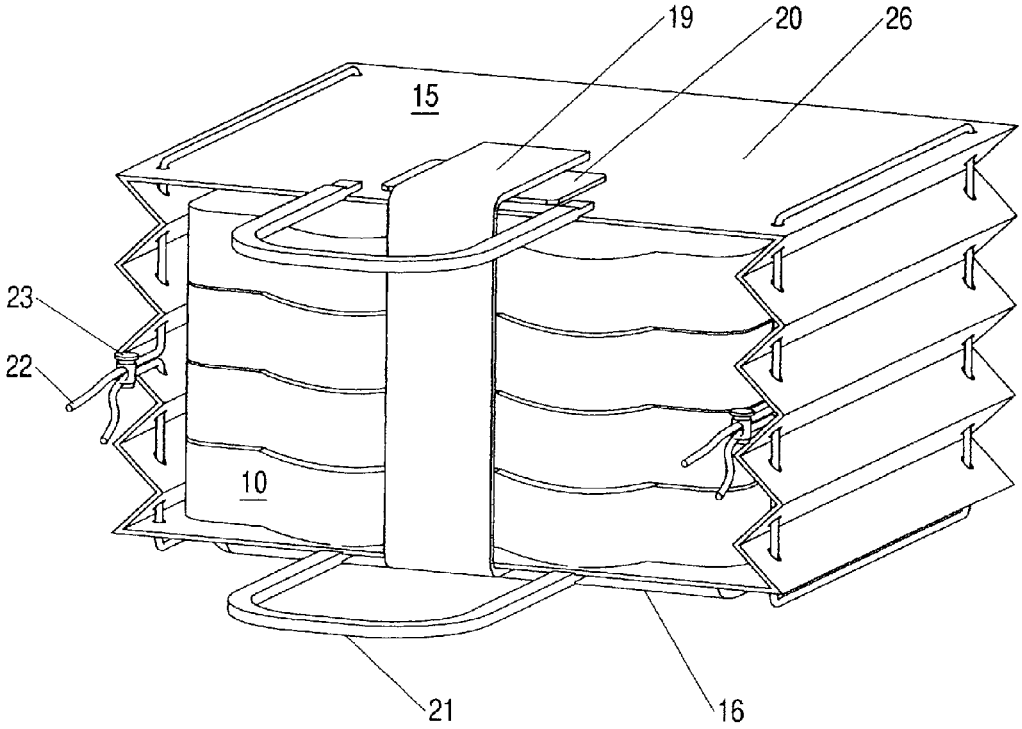
FIG. 4 is a view of all six components: the four identical seat pads and liner bag inside the padded carrying case.

FIG. 3 is the padded carrying case (15) component of the system. The padded carrying case is of sufficient size to accommodate the four identical seat pads (10) and a lightweight liner bag (25). The pleated sides (18) of the padded carrying case (15) have openings (17) to allow a drawstring or cord material (22) in FIG. 4 to be used to tighten the sides of the padded carrying case (15) with a cord stop (23) to firmly secure the contents in the padded carrying case (15). The padded carrying case (15) has the capability to adjust to house one to four seat pads (10). The padded carrying case (15) has a flap (19) attached to the back top opening of the padded carrying case (15). The flap (19) is secured to the front of the padded carrying case (15) by means of a hook and loop fastener material on the underside of the flap (19) and a corresponding material on the front closure surface (20) of the padded carrying case (15). The handles (21) are placed to allow easy access to the interior of the padded carrying case (15). A padded material (16) is attached to the back of the carrying case (15) to add comfort to the seating system, when placed on a chair.

The front of the padded carrying case, which is face down when the carrying case is placed on a chair, has a non-skid texture material (26) attached to the flat surfaces to prevent slippage of the case on a chair. The lightweight liner bag (25) is located inside the pocket (24) on the interior front panel of the padded carrying case (15). The liner bag (25) is used to discreetly hold unneeded seat pads (10) and is placed next to the user's chair.

Figure 5:
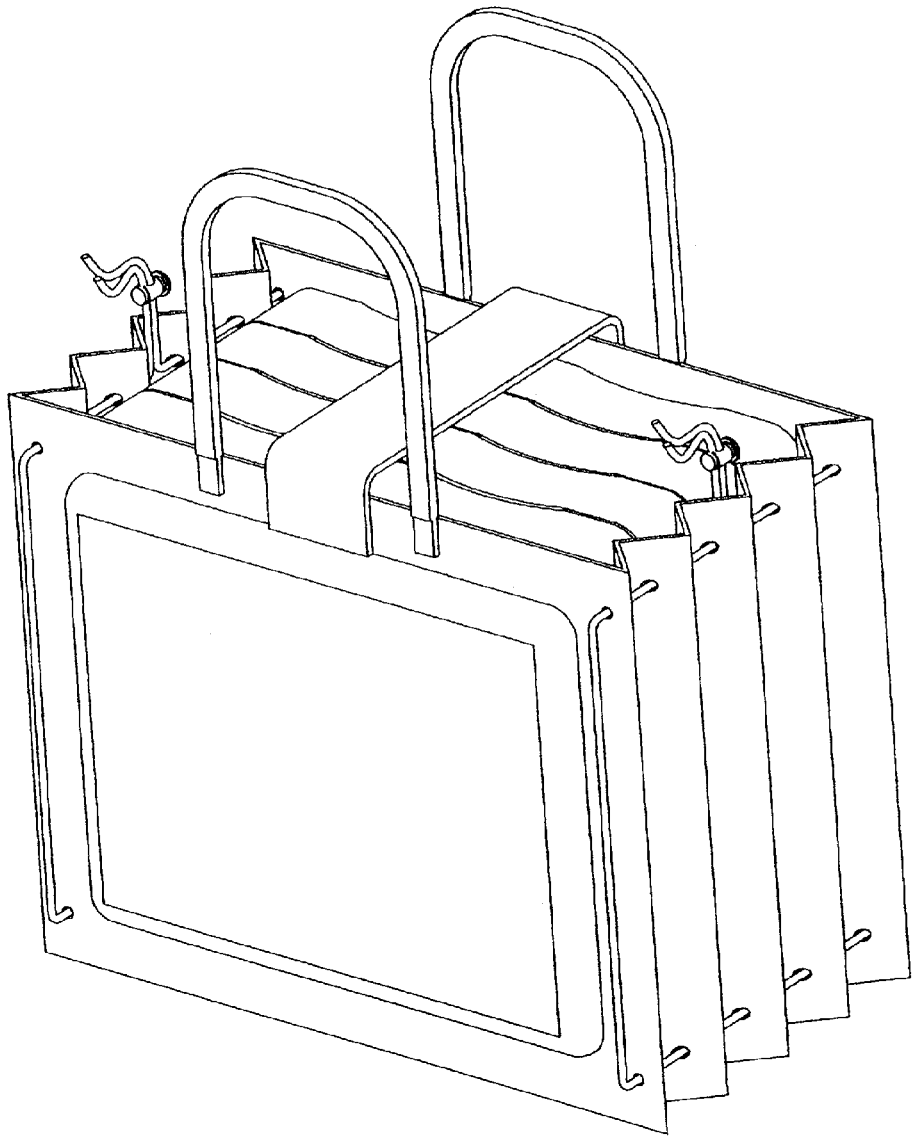
FIG. 5 is a view of the Booster Seat System.

FIG. 5 is a perspective of an entire Booster Seat System, ready for use.

A manufacturer would complete the engineering requirements for the necessary thickness and strength of the material used for the seating pads, most probably an injection molded polypropylene process, to determine the weight each seating pad would support. The engineering process would utilize whatever material best meets the support needs and also be a lightweight material for easy handling by a user. Each seating pad as well as any combination of the seating pads would have to be able to support the same target weight. For example: A Booster Seat System rated for up to 350 pounds: each seating pad would support 350 pounds. A second series of units could be engineered to support a target body weight in excess of 350 pounds to accommodate morbidly obese people. A third series of units could be engineered to support a lesser target weight to accommodate smaller framed people. The final weight of any Booster Seat System depends on the engineering requirements for strength for each target weight support category.

We claim:

1. A system comprising:

a carrying case having a top panel, a bottom panel, a side panel extending therebetween, and an opening defined thereby, wherein the side panel includes accordion-style pleats;

a first handle disposed on the top panel proximate the opening;

a second handle disposed on the bottom panel proximate the opening;

a liner bag sized to fit inside the carrying case;

a drawstring closure at an end of the liner bag;

a pocket disposed on the carrying case, wherein the pocket is sized to selectively receive the liner bag therein;

a set of four seat pads, each seat pad including a top surface, a bottom surface, at least one projection extending from one of the top surface and bottom surface on each seat pad, and at least one recess defined by the other one of the top surface and bottom surface on each seat pad;

a recessed area defined by the top surface of each seat pad;

wherein the projections are sized to fit into the corresponding recess when a first seat pad is stacked on a second seat pad;

wherein the top surface and the bottom surface of each seat pad is comprised of a non-skid textured material; and wherein the set of seat pads are sized to fit inside the liner bag.

2. A system comprising:

a carrying case having a top panel, a bottom panel, a side panel extending therebetween, and an opening defined thereby, wherein the side panel includes accordion-style pleats;

a first handle disposed on the top panel proximate the opening;

a second handle disposed on the bottom panel proximate the opening;

a liner bag sized to fit inside the carrying case;

a drawstring closure at an end of the liner bag;

a pocket disposed on the carrying case, wherein the pocket is sized to selectively receive the liner bag therein;

a plurality of seat pads, each seat pad including a first surface with a first stabilizer element, a second surface with a second stabilizer element configured to mate with the first stabilizer element of an adjacent seat pad when stacked therewith, a recessed area defined by the first surface, and a projection area extending from the second surface and sized to receive the recessed area of an adjacent seat pad when stacked therewith;

wherein at least one of the first surface and the second surface of each seat pad is comprised of a non-skid textured material; and wherein the plurality of seat pads are sized to fit inside the liner bag.

* * * * *

UNITED STATES PATENT AND TRADEMARK OFFICE

CERTIFICATE OF CORRECTION

PATENT NO. : 8,220,873 B2
APPLICATION NO. : 12/798172
DATED : July 17, 2012
INVENTOR(S) : Deborah Muller Kemp et al.

It is certified that error appears in the above-identified patent and that said Letters Patent is hereby corrected as shown below:

On the Title Page, left hand column, paragraph (54) and column 1, change the title from "Kemlok Adult Booster Seat System" to --Booster Seat System--

On the Title Page, left hand column between paragraphs (65) and (51), please insert the following:

--Related U.S. Application Data

(60) Provisional Application No. 61/276,151, filed on September 9, 2009.--

Signed and Sealed this
Twenty-seventh Day of November, 2012

David J. Kappos

David J. Kappos
*Director of the United States Patent and Trademark Office*